US010602893B2

(12) United States Patent
Isenberg et al.

(10) Patent No.: US 10,602,893 B2
(45) Date of Patent: Mar. 31, 2020

(54) SELF-PROPELLED CLEANING DEVICE

(71) Applicant: Vorwerk & Co. Interholding GmbH, Wuppertal (DE)

(72) Inventors: Gerhard Isenberg, Cologne (DE); Roman Ortmann, Duisburg (DE); Christian Holz, Dortmund (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 113 days.

(21) Appl. No.: 15/864,181

(22) Filed: Jan. 8, 2018

(65) Prior Publication Data

US 2018/0192834 A1 Jul. 12, 2018

(30) Foreign Application Priority Data

Jan. 9, 2017 (DE) ..... 10 2017 100 301

(51) Int. Cl.

| | |
|---|---|
| ***A47L 5/14*** | (2006.01) |
| ***A47L 9/00*** | (2006.01) |
| ***A47L 9/08*** | (2006.01) |
| ***A47L 9/28*** | (2006.01) |

(52) U.S. Cl.

CPC *A47L 5/14* (2013.01); *A47L 9/00* (2013.01); *A47L 9/08* (2013.01); *A47L 9/2805* (2013.01); *A47L 2201/00* (2013.01); *A47L 2201/04* (2013.01)

(58) Field of Classification Search

CPC ..... A47L 9/009; A47L 9/0686; A47L 9/1409; A47L 9/2826; A47L 9/2852; A47L 2201/04

USPC ..... 15/319, 339, 345

IPC ..... A47L 9/28

See application file for complete search history.

(56) References Cited

U.S. PATENT DOCUMENTS

| | | | | |
|---|---|---|---|---|
| 2013/0067680 | A1* | 3/2013 | Yoshida | A47L 5/14 15/345 |
| 2016/0000288 | A1* | 1/2016 | Soejima | A47L 9/2815 15/319 |
| 2017/0336798 | A1 | 11/2017 | Nam et al. | |
| 2018/0192837 | A1* | 7/2018 | Isenberg | A47L 9/0477 |

FOREIGN PATENT DOCUMENTS

| | | |
|---|---|---|
| DE | 10 2008 014 912 A1 | 9/2009 |
| DE | 10 2009 049 637 A1 | 4/2011 |

* cited by examiner

*Primary Examiner* — David Redding
(74) *Attorney, Agent, or Firm* — Collard & Roe, P.C.

(57) ABSTRACT

A self-propelled cleaning device has a housing, a fan and a surface cleaning system for cleaning a surface to be cleaned. In order to also be able to clean an above-floor surface, in particular a plateau of a baseboard, the cleaning device also has an above-floor cleaning system for cleaning an above-floor surface vertically offset relative to the surface to be cleaned. The above-floor cleaning system has a flow connection to a suction and/or blower unit having a fan, the flow opening of which has a difference in height of roughly 3 cm or more relative to a standing surface of the cleaning device by comparison to a usual orientation of the cleaning device for a cleaning operation.

10 Claims, 4 Drawing Sheets

SELF-PROPELLED CLEANING DEVICE

CROSS REFERENCE TO RELATED APPLICATIONS

Applicant claims priority under 35 U.S.C. § 119 of German Application No. 10 2017 100 301.0, filed Jan. 9, 2017, the disclosure of which is incorporated by reference.

BACKGROUND OF THE INVENTION

1. Field of the Invention

The invention relates to a self-propelled cleaning device with a housing, a fan, and a surface cleaning system for cleaning a surface to be cleaned.

The invention further relates to a method for operating a self-propelled cleaning device with a fan and a surface cleaning system, wherein a surface to be cleaned is exposed to streaming air from the fan.

2. Description of the Related Art

Self-propelled cleaning devices of the aforementioned kind are known in prior art. In particular, these are cleaning robots that can perform a dry- and/or wet cleaning job. During a cleaning operation, the cleaning device traverses the surface to be cleaned, and in the process removes dust or dirt from the surface to be cleaned, for example by means of a fan and/or any other cleaning elements that may be provided. The cleaning device here preferably navigates by means of a navigation and self-localization device within the environment, wherein distances from obstacles are measured to avoid a collision.

For example, publication DE 10 2008 014 912 A1 discloses a self-movable cleaning device with a distance meter for measuring the distance between the cleaning device and an object, for example an obstacle such as a wall or piece of furniture. The distance meter there has a triangulation system, for example, whose light source shines light onto the object to be measured and whose sensor detects light scattered or reflected by the object. The cleaning device thus receives information about the distance from the obstacle, so that a traversing strategy can be tailored thereto, and a collision with the latter is avoided in advance.

While being self-propelled, the cleaning device cleans the surface being traversed by the cleaning device. Cleaning takes place on the one hand by means of a vacuum generated by a fan, wherein dust and dirt are conveyed through a suction nozzle of the housing into a filter chamber of the cleaning device, and on the other hand usually while also interacting with a cleaning element, such as a bristle roller, which brushes over the surface to be cleaned, and in the process loosens up dust and dirt. Cleaning is here confined to the usually horizontally arranged surface on which the cleaning device moves. Subfloor surfaces are not cleaned.

Also known from 10 2009 049 637 A1 is a cleaning robot whose housing underside has secured to it a flexible cleaning wipe, whose edge area protruding over a guiding surface of the cleaning robot can be used for cleaning vertically arranged surfaces, for example baseboards. The edge area of the cleaning wipe arranged on the housing underside is tilted upward while approaching a corner, narrow section or baseboard, and there performs a cleaning action.

At best, the flexible, non-rigid design of the cleaning wipe makes it suitable to clean a lower area of a baseboard or an obstacle that faces the floor surface. Subfloor surfaces aligned essentially parallel to the floor surface can thus not be cleaned, since its low inherent rigidity causes the cleaning wipe to fold back toward the floor surface starting at a specific, slight difference in height.

SUMMARY OF THE INVENTION

Proceeding from the aforementioned prior art, the object of the invention is to provide a self-propelled cleaning device which, in addition to cleaning an essentially horizontal surface, in particular a floor surface, also makes it possible to clean a surface above the floor, for example the plateau of a baseboard.

In order to achieve the aforementioned object, the invention proposes that the cleaning device also have an above-floor cleaning system for cleaning an above-floor surface vertically offset relative to the surface, wherein the above-floor cleaning system has a flow connection to a suction and/or blower unit having a fan, the flow opening of which has a difference in height of roughly 3 cm or more relative to a standing surface of the cleaning device by comparison to a usual orientation of the cleaning device for a cleaning operation.

In addition to the usual surface cleaning system for cleaning a surface on which the cleaning device usually moves, the cleaning device according to the invention now also has an above-floor cleaning system for cleaning an above-floor surface located on a different level than the surface on which the cleaning device moves. As a consequence, the above-floor cleaning system is used in particular for cleaning baseboards, for example, the plateau of which often increasingly accumulates dirt and is not reached by the usual surface cleaning system of the cleaning device. It is here possible that the cleaning device simultaneously cleans a surface with the surface cleaning system and an above-floor surface by means of the above-floor cleaning system, so that the above-floor surface is automatically also cleaned during the usual cleaning operation known to the user. The above-floor cleaning system cleans the above-floor surface by means of a suction and/or blower unit, which has a flow opening directed toward the above-floor surface in such a way that suction material that accumulated there can be sucked in or blown off by the suction and/or blower unit. The flow opening is especially advantageously located above the plane of the above-floor surface, so that suction material can be exposed to blowing air from above, for example, as a result of which gravity causes the suction material to be transferred onto the surface, which is thereupon cleaned by the surface cleaning system in the usual manner. If the suction and/or blower unit is set up to vacuum suction material from the above-floor surface, it might be advisable for the flow opening to be arranged below the level of the above-floor surface, so that the suction material located on the above-floor surface can be transferred into the flow opening of the suction and/or blower unit through exposure to gravity. The flow opening of the suction and/or blower unit is positioned and aligned on the cleaning device in such a way that the opening plane of the flow opening lies at least 3 cm or more, for example up to 8 cm, above the standing surface of the cleaning device, and hence also above the surface on which the cleaning device is standing. The flow opening can basically also be higher than 8 cm, for example for especially high baseboards of 10 cm, 15 cm or more. The standing surface of the cleaning device is here usually prescribed by partial circumferential areas of the traversing wheels of the cleaning device. Alternatively or additionally, however, a standing surface—or at least a partial area thereof—can also be a partial circumferential area of a cleaning element, for example a cleaning roller or the like.

Given a conventional orientation of the cleaning device for a cleaning operation, the standing surface of the cleaning device coincides with a partial surface of the surface to be cleaned, namely in the area in which the surface is touched by the standing surface of the cleaning device, for example a partial circumferential surface of a traversing wheel. The suction and/or blower unit is thus aligned in such a way that it can direct suction and/or blowing air at the above-floor surface at a height of at least 3 cm. This height includes those height levels within which plateaus of baseboards are usually arranged. The above-floor cleaning system, in particular the flow opening, can be designed so that it can shift relative to the housing of the cleaning device, and thus also to the surface on which the cleaning device is standing, making it possible to vary the difference in height between the flow opening and standing surface of the cleaning device or the surface on which the cleaning device is standing. The height can here be adjusted automatically and/or manually by a user of the cleaning device.

In addition, it is proposed that the fan that exposes the suction and/or blower unit to suction and/or blowing air is a fan allocated to the surface cleaning system of the cleaning device or a fan designed separately to the fan of the surface cleaning device. In order to operate the suction and/or blower unit, a flow connection can be established between the latter and a fan in various ways. In a first embodiment, the suction and/or blower unit or its flow opening is connected to the fan of the cleaning device, which also exposes the surface cleaning system to suction air for cleaning a floor surface. To this end, a main flow channel of the cleaning device formed between a suction nozzle of the cleaning device and the suction side of the fan can have a branch line to the above-floor cleaning system, so that the flow opening of the suction and/or blower unit is also connected to the suction side of the fan, and thus can be exposed to a vacuum. The branch line can advantageously be switchable, i.e., can be closed or opened depending on the cleaning situation desired, so that suction material can be taken into the cleaning device either via the suction nozzle and/or via the above-floor cleaning system. As an alternative to also using the fan of the surface cleaning system for the above-floor cleaning system, the above-floor cleaning system can further also have fans designed separately from the fan of the surface cleaning system. This separate fan is then advantageously used only to expose the suction and/or blower unit to a vacuum or overpressure, so that the function of the suction and/or blower unit is completely independent of the function of the surface cleaning system. Likewise, this makes it possible to completely separate the flow paths of the surface cleaning system and above-floor cleaning system within the cleaning device, so that no branch lines, switching elements and the like are necessary.

It is further proposed that the suction and/or blower unit have a flow connection to a pressure side and/or a suction side of the fan. The fan can here be understood as either the fan of the surface cleaning system used for cleaning a floor surface, and/or a fan, in particular a separate fan, of the above-floor cleaning system. It is now possible to connect the suction and/or blower unit, i.e., its flow opening, with either the pressure side or suction side of the fan, so that either a blowing function on the one hand or a suction function on the other hand can be used on the above-floor surface. In the former case, in which the suction and/or blower unit has a flow connection with the pressure side of the fan, blowing air steams out of the flow opening onto the above-floor surface to be cleaned. Suction material located on the above-floor surface is here transported away, specifically preferably from the above-floor surface down to the surface below, in particular the floor surface, so that the cleaning device can vacuum the blown away suction material in the usual manner with the surface cleaning system. In the latter case, in which the suction and/or blower unit has a flow connection to the suction side of the fan, the suction material is sucked directly into the cleaning device through the flow opening of the suction and/or blower unit. The cleaning process for the above-floor surface is thus similar to the cleaning process for cleaning the floor surface by means of the surface cleaning system; in particular, the surface cleaning system and the suction and/or blower unit of the above-floor cleaning system can be simultaneously connected to the suction side of the fan, thus making it possible to vacuum off the above-floor surface while also vacuuming off the surface lying below in a vertical direction. As a consequence, the user does not have to perform a second procedural step, for example to initially clean a floor surface and then an above-floor surface, or vice versa. Instead, both cleaning processes take place in a single step, so that in the best case scenario, the user notices no difference in handling the cleaning device.

It is proposed that the above-floor cleaning system have a cleaning arm that provides a flow channel, and be at least partially arranged on the housing of the cleaning device from outside in such a way that the flow opening projects beyond an outer contour of the housing next to the housing. The cleaning arm is arranged on the housing of the cleaning device from outside, for example designed integrally with the housing or displaceably fastened to it, so that an end area of the cleaning arm having the flow opening projects beyond the outer contour of the housing in a horizontal direction—with the cleaning device oriented as during a usual cleaning operation, i.e., standing on a surface—and can clean the above-floor surface next to the cleaning device. In particular, the cleaning arm can be displaced relative to the housing, so that it can be adjusted in relation to a vertical direction and/or in relation to the displacement of the area of the cleaning arm having the flow opening within the same plane, for example, so that the flow opening can be displaced on one side of the housing, for example, or alternatively in the front and/or rear area of the housing. As a consequence, the cleaning arm can be adjusted especially flexibly relative to the housing, so as to be variably adjustable to an above-floor surface to be cleaned, depending on the current orientation of the cleaning device within an environment. In particular, the cleaning arm can be arranged on the housing in such a way that the end area of the cleaning arm having the flow opening has a distance of roughly 3 cm to 8 cm from the surface on which the cleaning device is standing in a vertical direction. The flow opening is here advantageously located at the height of the above-floor surface or above it, wherein a plateau of a baseboard can be cleaned as the above-floor surface, for example. The cleaning arm can be displaced by a motor, or alternatively or additionally manually by a user of the cleaning device. During a motorized displacement, in particular a detection system of the cleaning device can be used, which recognizes above-floor surfaces, for example plateaus of baseboards, and shifts the cleaning arm relative to the housing of the cleaning device so as to position the flow opening of the cleaning arm at a height where the above-floor surface can be cleaned, specifically so that at least a portion of the air sucked into or blown out of the flow opening streams over the above-floor surface to be cleaned.

In particular, it is proposed that the above-floor cleaning system have a cleaning arm that provides a flow channel, which relative to a cross section through the housing and cleaning arm essentially has an L-shape turned by 180 degrees, the longer leg of which is essentially vertically aligned in relation to a usual orientation of the cleaning device during a cleaning operation, and the shorter leg of which is aligned essentially horizontally. By correspondingly configuring the flow opening, the cleaning arm can in particular be specially designed to clean a baseboard, which has a vertical partial surface area on the one hand and a horizontal partial surface, specifically the baseboard plateau, on the other. As a consequence, the cleaning arm envelops the free surface of the baseboard in such a way that both the plateau and the lateral surface facing in the direction of the interior can be optimally cleaned. The flow opening of the suction and/or blower unit can here be formed on the long leg and/or the short leg, so that the suction and/or blower unit here cleans the lateral surface or the plateau or preferably both simultaneously. The cleaning arm can here also be formed on the housing in preferably a height-adjustable manner, so that the height of the horizontally aligned leg can be adjusted to the height of the above-floor surface, namely here the plateau of the baseboard, for example.

It is proposed that a valve element be arranged between the fan and the suction and/or blower unit, and set up to block or release a flow path. As a consequence, the valve element blocks the flow path between the fan and flow opening, so that air cannot get through the flow opening with the valve element closed, or air can stream through the flow opening with the valve element open. The configuration with one valve element is beneficial in particular when the above-floor cleaning system is connected to a flow channel of the surface cleaning system, for example by means of a branch line, since the flow paths of the surface cleaning system and above-floor cleaning system can thereby be situationally decoupled from each other, so that the entire flow of the fan can be made available for only the surface cleaning system, only the above-floor cleaning system or both simultaneously, depending on the current setting of the valve element. The valve element is especially preferably arranged on a branch line between a main flow channel of the cleaning device for supplying the surface cleaning system and a flow channel of the above-floor cleaning system, i.e., on the suction side of the fan. Alternatively, the valve element can also be allocated to the pressure side of the fan, wherein the suction and/or blower unit in this case is preferably designed exclusively as a blower unit, which relays the compressed air of the fan to the flow opening of the above-floor cleaning system.

In particular, it is proposed that the valve element can be switched as a function of a detection signal of a detection system, wherein the detection system is set up to detect an above-floor surface. The valve can be opened as a function of a detection signal, for example while approaching a room boundary, so that an above-floor surface located there can be correspondingly cleaned. For example, the detection system can have a sensor for measuring distance in proximity to the floor. For example, this sensor can be a distance sensor secured laterally relative to a usual traversing direction of the cleaning device, such as an ultrasound sensor, laser distance sensor and the like. In addition, it is also possible for the detection system to have a camera with corresponding image processor for recognizing an above-floor surface.

It can be provided that the detection system have two distance sensors, which in relation to a usual orientation of the cleaning device for a cleaning operation have detection ranges that are vertically offset to each other and overlap in a vertical direction relative to a projection. The two distance sensors are arranged on the housing in such a way as to enable the detection of an above-floor surface, for example a plateau of a baseboard. The sensors include a combination of two or more sensor elements, for example ultrasound sensors, infrared sensors, laser distance sensors or others, of which at least one determines a value for the distance from an object having an above-floor surface, in particular a baseboard. Accordingly, at least one additional distance sensor measures a distance at another height, so that a shape or height of the object can be inferred from a difference between the measured distances and the respective height, enabling in particular a determination of whether an above-floor surface like a baseboard is involved. In particular, the detection system can also have more than two distance sensors, for example a sensor array with a plurality of sensors, which relative to a usual orientation of the cleaning device during a cleaning operation are arranged vertically one above the other. The sensors in this sensor array measure a plurality of measuring values at varying distances from a floor surface, so that a contour of an object can be scanned, an actual height, for example the height of the baseboard, can be detected, and a height adjustment of the above-floor cleaning device can be correspondingly initiated. In particular, it can here be provided that one or more distance sensors of the detection system simultaneously be sensors that are present on the cleaning device anyway according to prior art, for example a measuring system, in particular a triangulation measuring system, for navigating and self-localizing the cleaning device or the like. When using the triangulation measuring system employed for navigation purposes, the distance from obstacles can advantageously be measured at an angle of 360 degrees.

In particular, it is proposed that a first distance sensor have a detection range with a distance of less than roughly 3 cm from a lowermost standing surface of the cleaning device at least in a partial area in relation to a vertical direction in space, and that a second distance sensor have a detection range with a distance of greater than roughly 8 cm from the lowermost standing surface in relation to the vertical direction in space. As a result of this embodiment, the distance sensors are positioned in such a way that at least one distance sensor has a detection range that encompasses a baseboard, and a second distance sensor has a detection range with no baseboard in relation to the same direction in space. The first distance sensor here determines a distance from an object, e.g., the baseboard in this case, while the second distance sensor, which potentially performs other tasks, such as navigating the cleaning device, can only be drawn upon if it has been determined that the cleaning device has approached the edge of a space. The distance between the second distance sensor and a floor surface is here dimensioned in such a way that its detection range lies above the detection range of the first distance sensor and above the upper edge of a conventional baseboard. The difference between the distance values measured by the two distance sensors makes it possible to infer the presence of a baseboard. For example, the detection ranges of the distance sensors can here be measuring planes of a sensor, which essentially lie parallel to a planar floor surface during a cleaning operation given a usual orientation of the cleaning device. Deviations might here arise if the floor surface is an uneven surface and/or a floor surface with elevations or inclinations.

Finally, it is proposed that the above-floor cleaning system have a mechanical cleaning element for mechanically cleaning the above-floor surface. For example, the mechanical cleaning element can be bristle elements, brushes, cleaning rollers, textile elements and the like. For example, the latter can usefully support an also provided suction or blower unit. The cleaning element can here especially preferably be arranged on a cleaning arm of the cleaning device, as already proposed above.

In addition to the cleaning device described above, the invention also proposes a method for operating a self-propelled cleaning device with a fan and a surface cleaning system, wherein a surface to be cleaned is exposed to streaming air from the fan, wherein an above-floor cleaning device of the cleaning device cleans an above-floor surface vertically offset relative to the surface by exposing the above-floor surface to blowing air from the fan of the cleaning device while arranging the cleaning device on the surface, wherein the above-floor cleaning system blows out the blowing air against a usual forward traveling direction of the cleaning device, wherein the cleaning device subsequently turns and travels opposite the previous forward traveling direction, while the surface cleaning system vacuums suction material blown down from the above-floor surface from the surface. In particular, the method is suitable for operating a self-propelled cleaning device described above. The method now on the one hand involves cleaning a surface by means of a surface cleaning system, in particular a floor surface traversed by cleaning device, and on the other hand cleaning an above-floor surface, for example which can be a plateau of a baseboard. In particular, a suction capacity of a fan of the cleaning device can at times be available either only to the surface cleaning system or only to the above-floor cleaning system. If the surface and above-floor surface are cleaned simultaneously and by means of the same fan, a fan power of the cleaning device is divided, so that both cleaning processes can take place successfully. However, it can also be provided that a fan designed separately from the fan for the surface cleaning system be used for operating the above-floor cleaning system. As a result, the two cleaning processes can be executed completely independently of each other, and in particular are also separated in relation to the involved flow paths. The above-floor surface is cleaned by blowing, wherein the above-floor cleaning system blows blowing air onto the above-floor surface, so that the suction material located on the above-floor surface is removed, and preferably blown to the surface arranged under the above-floor surface, wherein cleaning subsequently takes place by means of the surface cleaning system, and allows the suction material to be transferred into the suction material chamber of the cleaning device. The process thus provides for two consecutive procedural steps, wherein a first procedural step provides that [the above-floor surface is] blowing air is initially directed onto the above-floor surface opposite a usual forward traveling direction of the cleaning device. At any rate, the direction opposite the forward traveling direction usually corresponds the direction in which exhaust air from the fan for the surface cleaning system is blown out of the cleaning device on the pressure side. This exhaust air is now used to blow off the above-floor surface. After the blowing-off process, the cleaning device turns and travels opposite the previous forward traveling direction while blowing off the above-floor surface, with the cleaning device resultantly traversing the partial area of the surface on which the suction material removed from the above-floor surface has fallen. In particular, the cleaning device can move along a baseboard during the blowing-off process, then turn by 180 degrees in the horizontal plane and travel in the opposite direction, once again along the baseboard, so as to collect the blown-off suction material.

Alternatively proposed is a method for operating a self-propelled cleaning device with a fan and a surface cleaning system, wherein the surface to be cleaned is exposed to streaming air from the fan, and wherein an above-floor cleaning system of the cleaning device cleans an above-floor surface vertically offset relative to the surface by exposing the above-floor surface to blowing air from the fan of the cleaning device while arranging the cleaning device on the surface, wherein the above-floor cleaning system blows out the blowing air in a usual forward traveling direction of the cleaning device, the surface cleaning system vacuums suction material blown down off the above-floor surface from the surface.

A separate fan can be used for blowing off the above-floor surface, wherein the separate fan can be arranged inside of the cleaning device in such a way that blowing air streams out of the fan on the pressure side of the fan in a usual forward traveling direction of the cleaning device, and thereby blows suction material from the above-floor surface onto the surface in the traveling direction of the cleaning device. As a consequence, the suction material can be removed from the above-floor surface and vacuumed up in a single step and using just one traveling direction. Of course, it is alternatively also possible that the exhaust air of the fan likewise used for the surface cleaning system be blown out of the cleaning device in a usual forward direction of the cleaning device, so that suction material can be removed from the above-floor surface and picked up from the surface, for example the floor surface, in one step in this case as well. Because blowing out takes place in the forward traveling direction, it is not required that the cleaning device turn between the blowing-off process on the above-floor surface and vacuuming process on the surface. This makes the method especially expeditious to use. It can further be provided that blowing air be simultaneously blown out in both the usual forward traveling direction of the cleaning and in the opposite direction. This can advantageously elevate the cleaning power of the cleaning device.

It can further be provided that part of a suction air stream of the surface cleaning system be used to vacuum off the above-floor surface, for example with the help of switchable valve elements. Either all of the streaming air of the fan can here be used for cleaning the above-floor surface, or alternatively only a specific percentage. To this end, the flow paths of the surface cleaning system and above-floor cleaning system can be correspondingly switched.

The above-floor cleaning operation is advantageously supported by a mechanical cleaning element. For example, this cleaning element can be a brush. A vertical position of the cleaning element can be automatically set by the cleaning device based on a detected height of the above-floor surface, in particular by means of an elevated screw gearing. For example, the required height can be detected via a detection system, preferably an infrared sensor array or the like. The sensor array can be mounted upstream from the cleaning element in the direction of movement of the cleaning device, so as to detect potential obstacles or changes in height of the above-floor surface in advance, and introduce changes or evasive maneuvers.

In addition, the method can also provide that cleaning data about cleaning processes of the cleaning device be stored, for example so that a floor surface does not get cleaned if an evaluation and control system has determined that this has recently already been done. In this case, for example, only an above-floor surface is cleaned without including the floor surface. In like manner, a procedure can also provide that an above-floor surface not be cleaned if this has recently already been done, and that in this case, only a surface is cleaned by means of the surface cleaning system.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
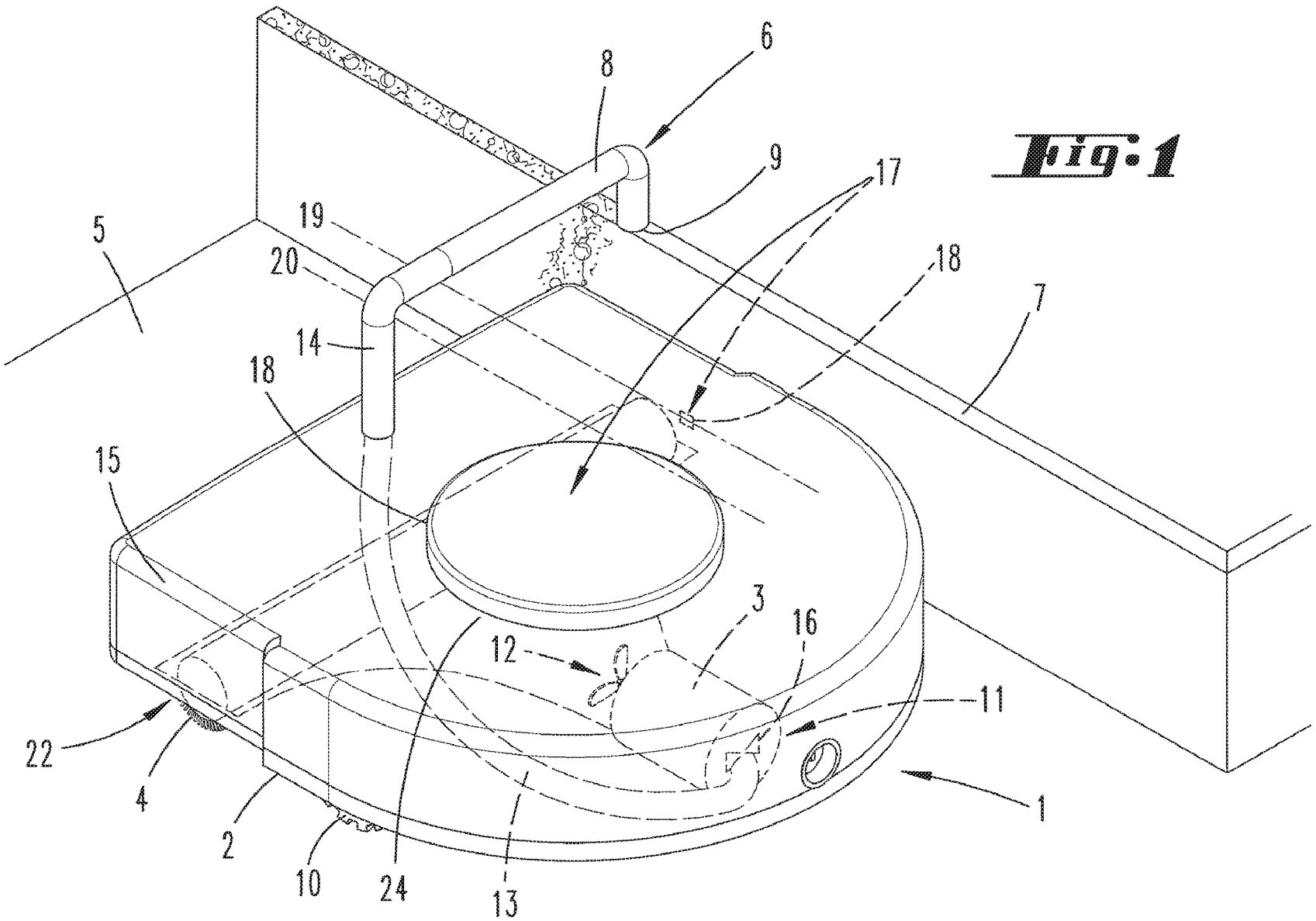
FIG. 1 is a cleaning device according to the invention in a first embodiment.

FIG. 1 shows a cleaning device 1, which is here designed as a self-propelled robotic vacuum. The cleaning device 1 has a housing 2 with an outer contour 15, which reflects the outline of the cleaning device given a vertical projection of the housing 2. Arranged inside of the housing 2 is a fan 3, which has a flow connection with a suction nozzle 22 on a suction side 12 on the one hand, and with a suction and/or blower unit 8 on the pressure side 11 on the other. Arranged in the suction nozzle 22 of the cleaning device 1 is a surface cleaning system 4, which here is designed as a brush roller. A main flow channel 13 runs from the suction nozzle 22 to the fan 3. Located on the pressure side 11 of the fan 3 is a flow channel 13, which leads to an above-floor cleaning system 6 having the suction and/or blower unit 8. A valve element 16 is located between the fan 3 and flow channel 13, and can block or release a flow path from the fan 3 to the flow channel 13.

The suction and/or blower unit 8 of the above-floor cleaning device 6 has a cleaning arm 14, which partially takes up the flow channel 13, and at a free end area has a flow opening 9 through which suction air and/or blowing air can stream. The cleaning arm 14 is here formed on the upper side of the housing 2 of the cleaning device 1, and essentially extends like an upside down U toward the end area having the flow opening 9.

The cleaning device 1 further has a standing surface 10, which here has partial circumferential areas of the traversing wheels of the cleaning device 1. This standing surface 10 rests on a surface 5 to be cleaned, specifically a floor surface. Located next to the housing 2 of the cleaning device 1 is an above-floor surface 7, specifically here a plateau of a baseboard.

The cleaning device 1 further has an additional brush 23 on the underside of the housing 2, which serves to clean transitions between the surface 5 and a vertical room boundary area.

The cleaning device 1 has a detection system 17 with two different distance sensors 18. A first distance sensor 18 arranged perpendicular to a usual traversing direction on the housing 2 of the cleaning device 1 is here an ultrasound sensor, which can measure distances from obstacles. A second distance sensor 18 (not visible on the figures) is part of a triangulation measuring system, which simultaneously serves to navigate and self-localize the cleaning device 1 within an environment. While traversing the environment, the triangulation measuring system recognizes obstacles that block a traversing path, for example room boundaries, pieces of furniture and the like. A light source emits a light beam and receives reflections or scattered light components of the emitted light from varying distances. The distance of the reflecting obstacle can be inferred from this. The distance sensor 18 designed as an ultrasound sensor has a detection range 19 lying below a detection range 20 of the triangulation measuring system. The distance between the planes of the two detection ranges 19, 20 here relates to the depicted orientation of the cleaning device 1, in which the cleaning device 1 rests on the surface to be cleaned 5 with the standing surface 10, which corresponds to a usual orientation of the cleaning device 1 during a cleaning operation.

For example, the invention in this embodiment functions in such a way that the cleaning device 1 moves within the environment during a cleaning operation, for example traverses the surface 5 to be cleaned. The detection system 17 here continuously detects obstacles within the environment of the cleaning device 1. As soon as the two distance sensors 18 of the detection system 17 detect a deviating distance from an obstacle in relation to an identical direction in space, an evaluation and control system of the cleaning device 1 infers the existence of an obstacle with a height lying between the detection range 19 of the first distance sensor 18 and the detection range 20 of the distance sensor 18 of the triangulation measuring system. The obstacle here involves a baseboard, whose above-floor surface 7, namely its plateau, lies above the detection range 19 of the distance sensor 18 designed as an ultrasound sensor, but below the detection range 20 of the distance sensor 18 of the triangulation measuring system. Given a difference in distance of 0.5 mm to 30 mm, for example, the measured difference in distance can be used to infer the existence of a baseboard as the obstacle, in particular when the two detection ranges 19, 20 lie below or above a usual height of a baseboard, for example by between 30 mm and 80 mm, as in this case. As soon as the evaluation and control system of the cleaning device 1 has inferred the existence of an above-floor surface 7, the cleaning device 1 is moved toward the above-floor surface, so that the cleaning device 1 passes by the obstacle having the above-floor surface 7 with a lateral area of the housing 2 in relation to a usual forward traveling direction. The orientation and height of the cleaning arm 14 of the suction and/or blower unit 8 are aligned in such a way that its flow opening 9 is arranged above the above-floor surface 7.

In order to clean the above-floor surface 7, the valve element 16 arranged between the pressure side 11 of the fan 3 and the flow channel 13 of the suction and/or blower unit 8 is opened, so that the compressed air of the fan 3 can stream into the flow channel 13 and to the cleaning arm 14. The blowing air streams through the cleaning arm 14, and reaches the flow opening 9, which is arranged above the above-floor surface 7. The blowing air passes through the flow opening 9 and reaches the above-floor surface 7, where it blows suction material located there off the above-floor surface 7 down onto the surface 5. After a prescribed traversing path, for example after arriving at another room boundary in a forward traveling direction, the cleaning device 1 turns by 180 degrees and travels along the baseboard in the opposite direction. The suction material previously blown off the above-floor surface 7 down onto the surface 5 is here sent to the cleaning device 1 in the usual manner by means of the surface cleaning system 4 of the cleaning device 1 or via the suction nozzle 22, where it gets into a dust chamber.

Another embodiment not further shown can provide that the flow channel 13 of the suction and/or blower unit 8 be connected to the suction side 12 of the fan 3, for example to a branch line of the main flow channel 24. As a consequence, the flow opening 9 of the cleaning arm 14 is exposed to suction air, so that the suction material arranged on the above-floor surface 7 is sucked into the cleaning arm 14 through the flow opening 9, and passes through the flow channel 13 to reach a suction material chamber of the cleaning device 1. In this embodiment, the suction material located on the above-floor surface 7 is sucked into the cleaning device 1 without the participation of the surface cleaning system 4.

Figure 2:
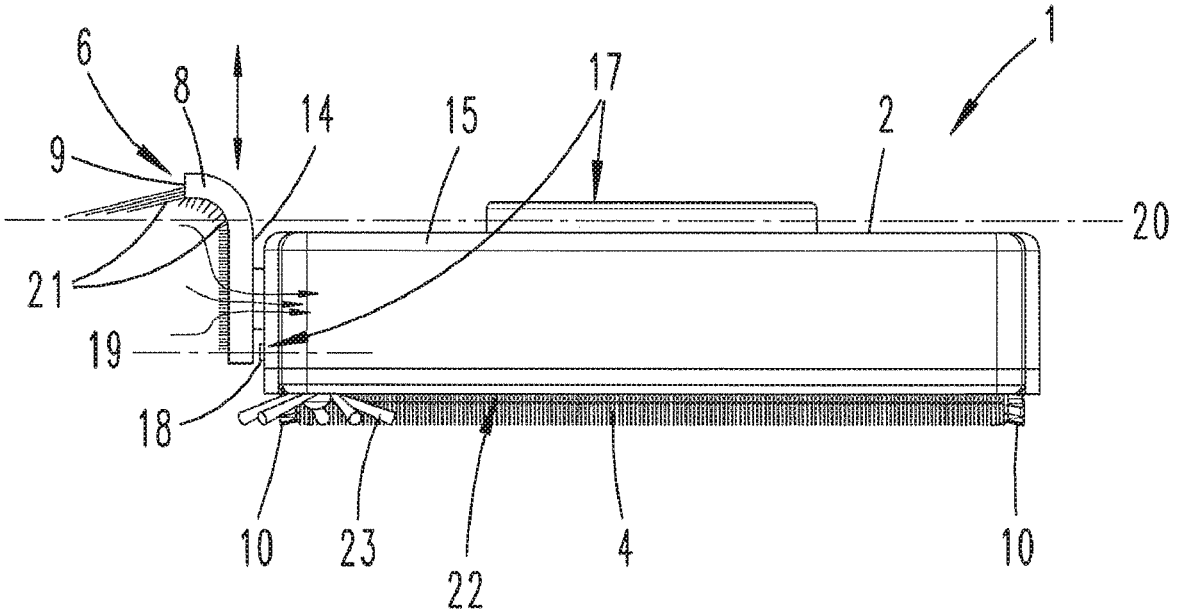
FIG. 2 is a front view of a cleaning device according to the invention in a second embodiment.
Figure 3:
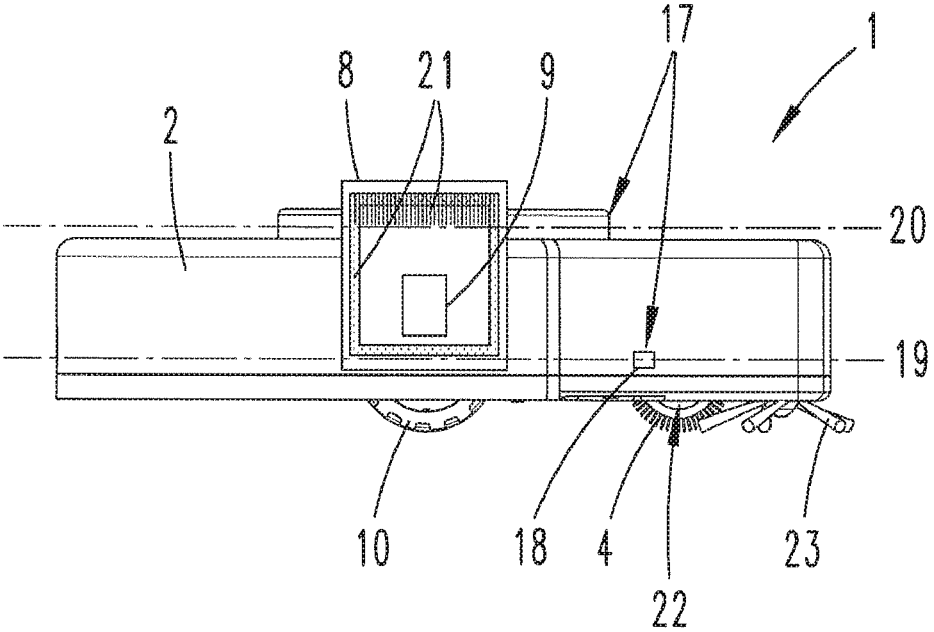
FIG. 3 is a side view of the cleaning device on FIG. 2.
Figure 4:
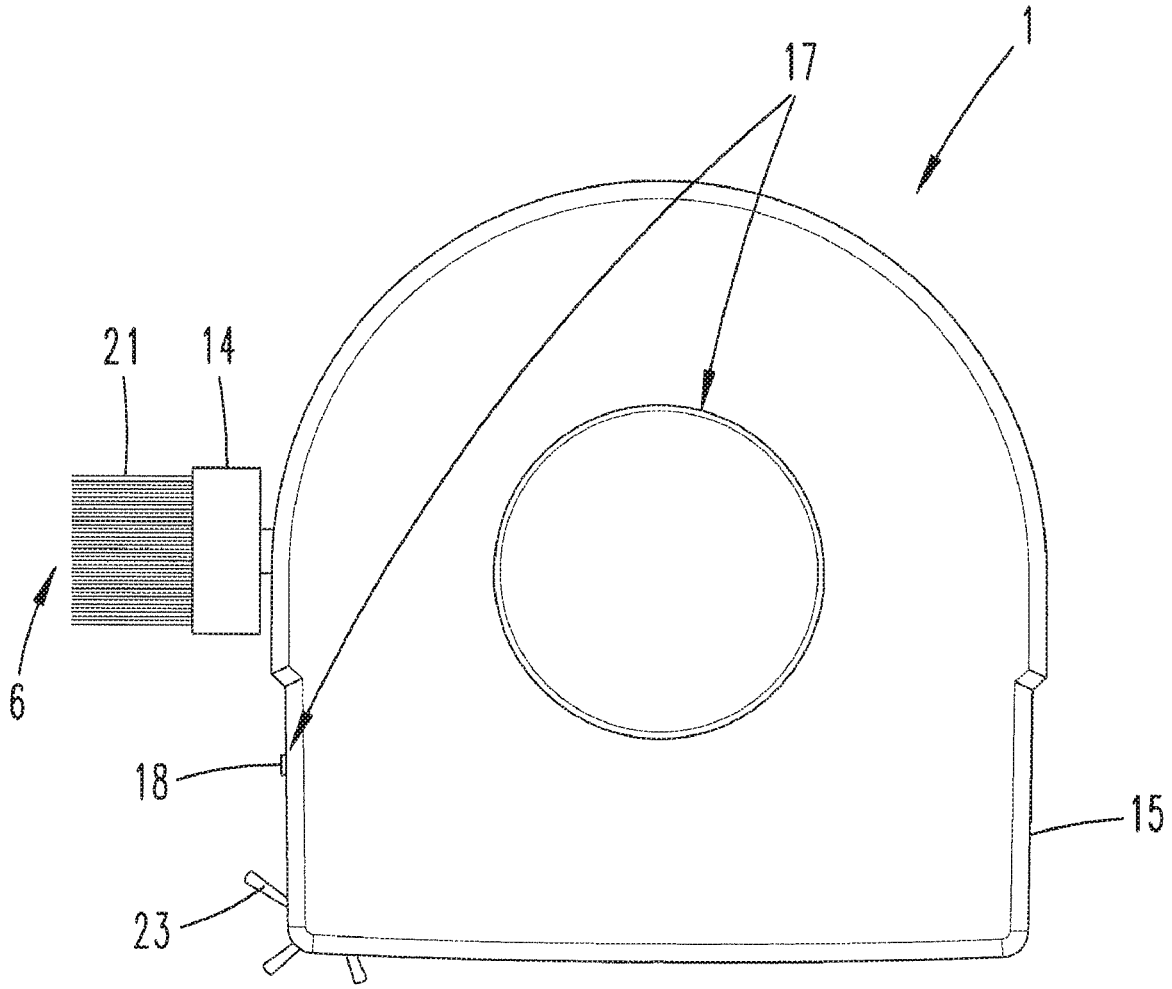
FIG. 4 is a top view of the cleaning device on FIGS. 2 and 3.

FIGS. 2 to 4 show another possible embodiment of the invention, in which the cleaning device 1 has a suction and/or blower unit 8 arranged on the housing 2 laterally in relation to a usual forward traveling direction. The suction and/or blower unit 8 has a cleaning arm 14 with an essentially L-shaped cross section, wherein the L-shape is turned opposite the usual orientation of an L by 180 degrees, so that the short leg is arranged above the long leg. The front view of the cleaning device 1 on FIG. 2 shows the cleaning arm 14 with cleaning elements 21 that are designed as bristles, and face in a direction away from the housing 2 proceeding from the cleaning arm 14, specifically in the direction of an obstacle to be cleaned. The cleaning elements 21 arranged on the short leg of the cleaning arm 14 here serve to clean an above-floor surface 7, while the cleaning elements 21 arranged on the long leg of the cleaning arm 14 serve to brush over a vertically standing lateral surface of the baseboard that has the above-floor surface 7.

FIG. 3 presents a side view of the cleaning device 1 according to FIG. 2. As evident, the suction and/or blower unit 8, apart from the cleaning elements 21, has a flow opening 9 through which suction and/or blowing air can stream. The cleaning elements 21 of the cleaning arm 14 are guided around the flow opening 9 in the circumferential direction, so that they simultaneously represent a sealing element for the flow opening 9. Finally, FIG. 4 presents a top view of the cleaning device 1 with the suction and/or blower unit 8.

In the embodiment shown on FIGS. 2 to 4, for example, the above-floor surface 7 is cleaned in such a way that the flow opening 9 has a flow connection with a suction side 12 of the fan 3 of the cleaning device 1. As a result, the flow opening 9 is exposed to a vacuum, which sucks suction material from the above-floor surface 7 and lateral surface of the baseboard into the flow channel 13 of the cleaning arm 14. The cleaning elements 21 abut against the above-floor surface 7 and lateral surface of the baseboard, and seal the flow channel 13 at the flow opening 9. As the cleaning elements 21 of the short leg abut against the above-floor surface 7, the L-shape of the cleaning arm 14 automatically positions the flow opening 9 in such a way that the flow opening 9 lies within the partial area of the cleaning arm 14 bordered by the cleaning elements 21. The flow opening 9 thus exposes a height range here measuring roughly 3 cm to 8 cm to a vacuum. As a consequence, suction material can be vacuumed off both on the lateral surface of the baseboard and on the above-floor surface 7 of the baseboard.

The statements made above about the detection system 17 of the cleaning device 1 and/or of the valve element 16 also apply with respect to the second exemplary embodiment.

In addition, it is of course also possible to design the suction and/or blower unit 8 in the second exemplary embodiment in such a way that the cleaning arm 14 blows blowing air onto the above-floor surface 7, and that the suction material thereby transferred onto the surface 5 is subsequently vacuumed by means of the surface cleaning system 4 from the surface 5, specifically the floor surface.

Figure 5:
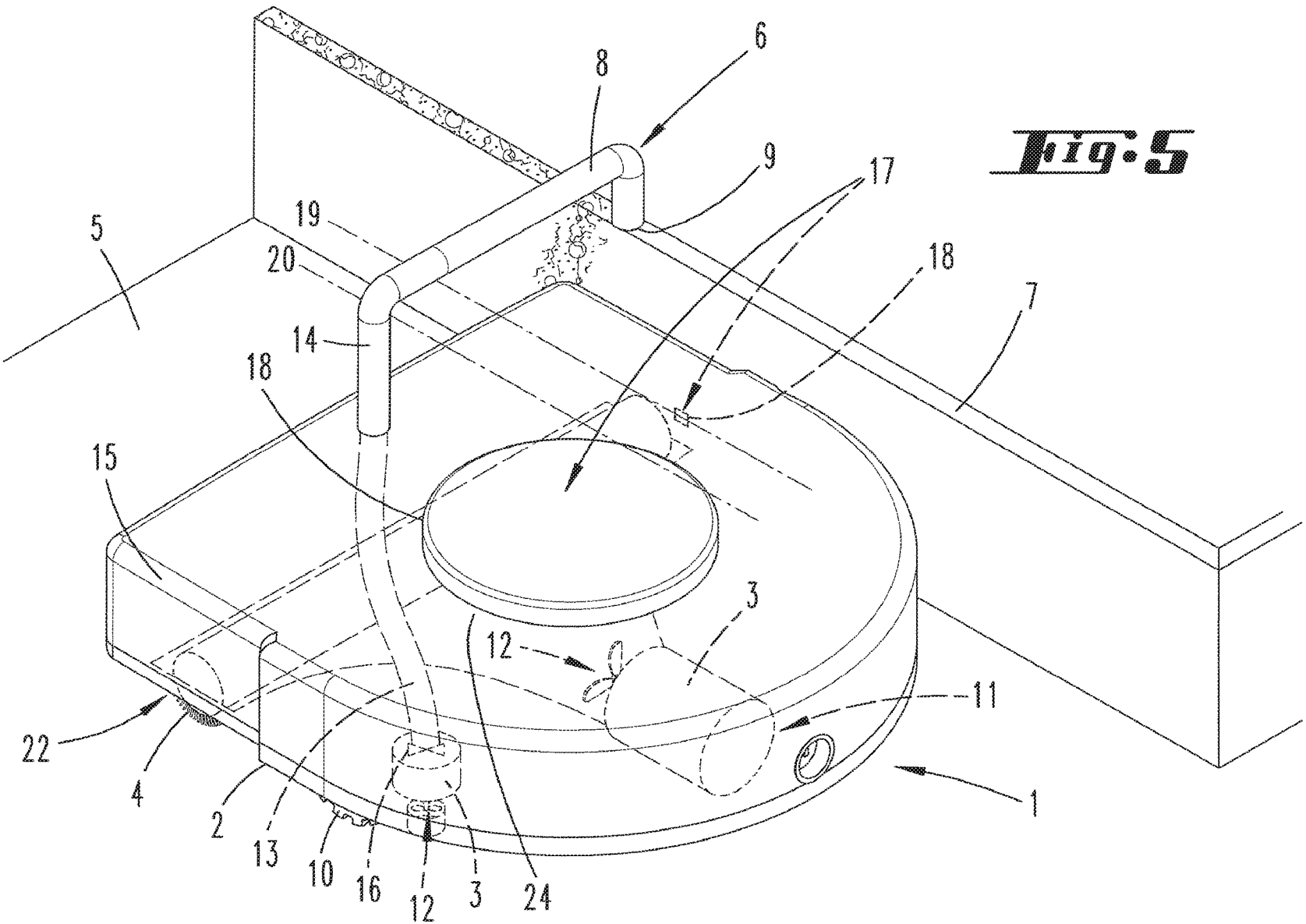
FIG. 5 is a cleaning device according to the invention in a third embodiment.

FIG. 5 shows a cleaning device 1 according to another possible embodiment of the invention. The cleaning device 1 is mainly built like the cleaning device 1 according to FIG. 1 but has a fan 3 designed separately to the fan 3 of the surface cleaning device 1. Thus, the fan 3 that exposes the suction and/or blower unit 8 to suction and/or blowing air is an additional fan 3. A valve element 16 is located between the fan 3 and a separate flow channel 13, and can block or release a flow path from the fan 3 to the flow channel 13.

It goes without saying that subcombinations of the depicted suction and/or blower units 8 are further possible. Apart from the depicted robotic vacuum, the cleaning device 1 can further be a combined vacuum-wiping device or the like.

Although only a few embodiments of the present invention have been shown and described, it is to be understood that many changes and modifications may be made thereunto without departing from the spirit and scope of the invention.

LIST OF REFERENCES

1 Cleaning device
2 Housing
3 Fan
4 Surface cleaning system
5 Surface
6 Above-floor cleaning system
7 Above-floor surface
8 Suction and/or blower unit
9 Flow opening
10 Standing surface
11 Pressure side
12 Suction side
13 Flow channel
14 Cleaning arm
15 Outer contour
16 Valve element
17 Detection system
18 Distance sensor
19 Detection range
20 Detection range
21 Cleaning element
22 Suction nozzle
23 Brush
24 Main flow channel

What is claimed is:

1. A self-propelled cleaning device, comprising:

a housing, a first fan, a surface cleaning system for cleaning a surface to be cleaned, and an above-floor cleaning system for cleaning an above-floor surface vertically offset relative to the surface to be cleaned, said above-floor cleaning system having a flow connection to a suction and/or blower unit having a second fan and a flow opening, said flow opening having a difference in height of at least 3 cm relative to a standing surface of the cleaning device, wherein the first fan is separate from the second fan, and wherein the above-floor cleaning system has a cleaning arm that provides a flow channel and can shift relative to the housing, said cleaning arm being at least partially arranged on the housing of the cleaning device from outside in such a way that a flow opening of the flow channel protrudes beyond an outer contour of the housing next to the housing.

2. The cleaning device according to claim 1, wherein the suction and/or blower unit has a flow connection to a pressure side and/or a suction side of the second fan.

3. A self-propelled cleaning device, comprising:

a housing, a first fan, a surface cleaning system for cleaning a surface to be cleaned, and an above-floor cleaning system for cleaning an above-floor surface vertically offset relative to the surface to be cleaned, said above-floor cleaning system having a flow connection to a suction and/or blower unit having a second fan and a flow opening, said flow opening having a difference in height of at least 3 cm relative to a standing surface of the cleaning device, wherein the first fan is separate from the second fan, and wherein the above-floor cleaning system has a cleaning arm that provides a flow channel, which relative to a cross section through the housing and cleaning arm essentially has an L-shape turned by 180 degrees, a longer leg of which is essentially vertically aligned in relation to a usual orientation of the cleaning device during a cleaning operation, and a shorter leg of which is aligned essentially horizontally.

4. The cleaning device according to claim 1, A self-propelled cleaning device, comprising:

a housing, a first fan, a surface cleaning system for cleaning a surface to be cleaned, and an above-floor cleaning system for cleaning an above-floor surface vertically offset relative to the surface to be cleaned, said above-floor cleaning system having a flow connection to a suction and/or blower unit having a second fan and a flow opening, said flow opening having a difference in height of at least 3 cm relative to a standing surface of the cleaning device, wherein the first fan is separate from the second fan, and wherein a valve element is arranged between the second fan and the suction and/or blower unit, said valve element being configured to block or release a flow path.

5. The cleaning device according to claim 4, wherein the valve element is configured to be switched as a function of a detection signal of a detection system, wherein the detection system is set up to detect an above-floor surface.

6. The cleaning device according to claim 1, wherein the above-floor cleaning system has a mechanical cleaning element for mechanically cleaning the above-floor surface.

7. The cleaning device according to claim 3, wherein the suction and/or blower unit has a flow connection to a pressure side and/or a suction side of the second fan.

8. The cleaning device according to claim 4, wherein the suction and/or blower unit has a flow connection to a pressure side and/or a suction side of the second fan.

9. The cleaning device according to claim 3, wherein the above-floor cleaning system has a mechanical cleaning element for mechanically cleaning the above-floor surface.

10. The cleaning device according to claim 4, wherein the above-floor cleaning system has a mechanical cleaning element for mechanically cleaning the above-floor surface.

* * * * *